United States Patent [19]

Tuckey

[11] Patent Number: 4,625,695

[45] Date of Patent: Dec. 2, 1986

[54] FUEL PRESSURE REGULATOR

[75] Inventor: Charles H. Tuckey, Cass City, Mich.

[73] Assignee: Walbro Corporation, Cass City, Mich.

[21] Appl. No.: 717,017

[22] Filed: Mar. 28, 1985

[51] Int. Cl.[4] ..... F02M 37/04

[52] U.S. Cl. ..... 123/463; 123/512; 137/510; 267/177; 92/97

[58] Field of Search ..... 137/510; 123/511, 512, 123/514, 459, 463; 92/97, 98 R, 99, 103 M; 267/170, 177

[56] References Cited

U.S. PATENT DOCUMENTS

| | | | |
|---|---|---|---|
| 1,783,646 | 12/1930 | Hajek | 137/510 |
| 1,786,844 | 12/1930 | Hesselman | 137/510 |
| 1,871,535 | 8/1932 | Lattuer | 137/510 X |
| 1,946,188 | 2/1934 | Birch | 137/510 X |
| 2,577,967 | 12/1951 | Hughes | 92/97 X |
| 2,704,548 | 3/1955 | Ralston | 137/510 X |
| 3,228,419 | 1/1966 | Smith | 137/540 |
| 3,662,779 | 5/1972 | Weber | 137/510 X |
| 4,204,561 | 5/1980 | Ludwig | 137/510 |

FOREIGN PATENT DOCUMENTS

| | | | |
|---|---|---|---|
| 1056256 | 6/1979 | Canada | 137/510 |
| 950511 | 2/1964 | United Kingdom | 137/510 |
| 1208796 | 10/1970 | United Kingdom | 137/510 |

*Primary Examiner*—Harold W. Weakley

*Attorney, Agent, or Firm*—Barnes, Kisselle, Raisch, Choate, Whittemore & Hulbert

[57] ABSTRACT

A pressure regulator valve for use in fuel systems for internal combustion engines which includes a two-part housing lamination with a diaphragm between the bottom and top housings and a valve back-up pad above the diaphragm. The diaphragm is responsive to fuel pressure and will open a valve to by-pass fuel to a fuel tank. A centering diaphragm functions to locate a back-up pad above the valve seat. In one embodiment, the regulator valve pad controlled by the diaphragm is dimensioned with a diameter significantly larger than the effective valve seat area to insure full valve seat opening even when the valve pad is cocked slightly relative to the valve seat area. A press-on spring cap or cup allows calibration of the unit during assembly with a strike-in to fix the calibration in a tamperproof structure.

3 Claims, 3 Drawing Figures

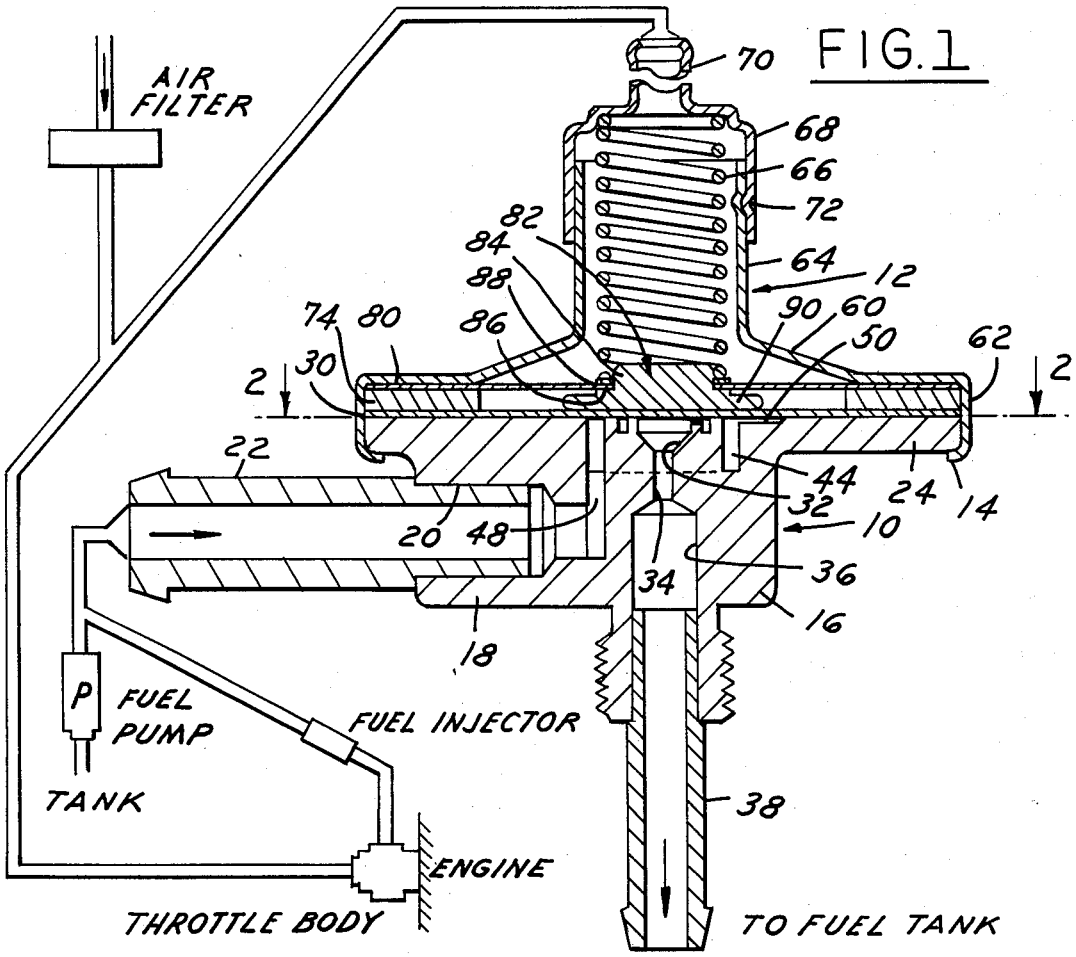
FIG. 1
FIG. 2
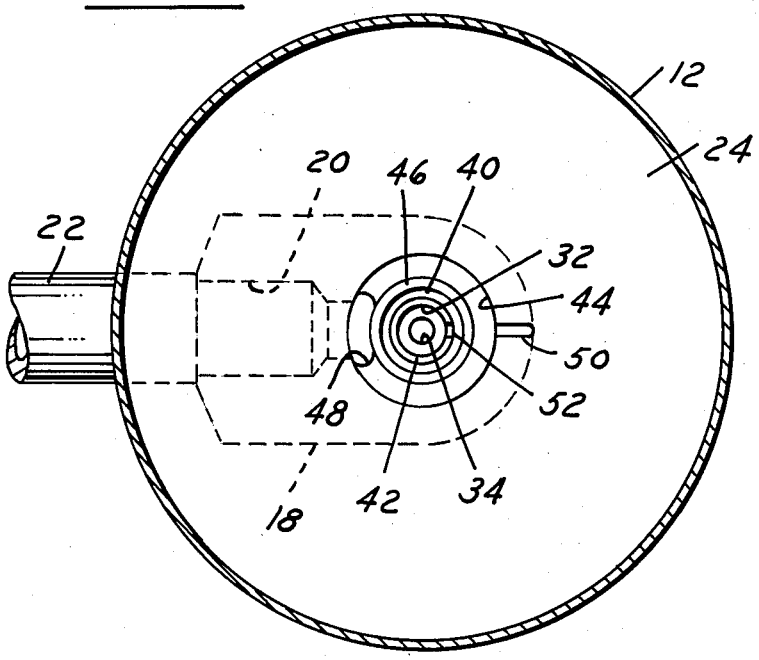

FUEL PRESSURE REGULATOR

REFERENCE TO RELATED APPLICATION

Reference is made to my copending U.S. application, Ser. No. 642,776, filed Aug. 21, 1984, now U.S. Pat. No. 4,543,935 on a Pressure Regulator With Variable Response.

FIELD OF INVENTION

Fuel systems for internal combustion engines.

BACKGROUND OF INVENTION

Constant pressure regulator valves have been utilized in fuel systems for quite some time. One example is found in a U.S. Pat. to Fehrenbach et al., No. 3,511,170, issued May 12, 1970.

It is an object of the invention to provide an improved regulator valve which has a quick response to the varying pressures in a fuel circuit. It is a further object to provide a regulator valve which responds with a full opening of the valve area when the pressures in the system are such that by-passing of fuel is required.

A further object lies in the construction of the valve housing which facilitates assembly and initial fixed pressure calibration which prevents subsequent maladjustment by a user.

Numerous objectives and features of the invention will be apparent in the following specification and claims in which the invention is described together with details to enable persons skilled in the art to practice the invention, all in connection with the best mode presently contemplated for the invention.

BRIEF DESCRIPTION OF THE DRAWINGS

Drawings accompany the disclosure and the various views thereof may be briefly described as:

FIG. 1, a vertical sectional view of the pressure regulator structure to be disclosed herein and the circuit in which it is utilized.

FIG. 2, a sectional view on line 2—2 of FIG. 1.

DETAILED DESCRIPTION OF THE INVENTION AND THE MANNER AND PROCESS OF USING IT

Figure 3:
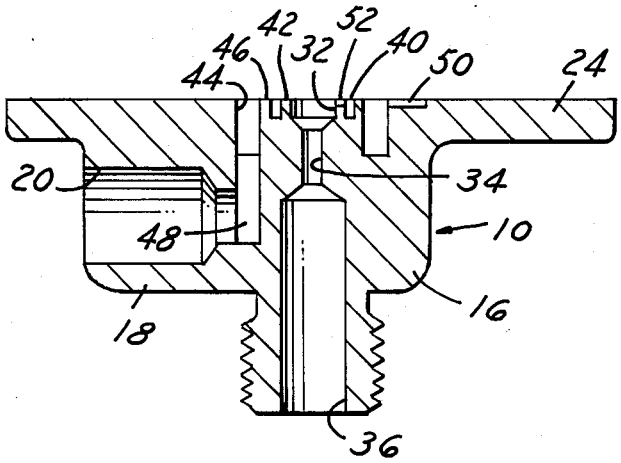
FIG. 3, a separate view of the base housing of the regulator.

The pressure regulator illustrated in FIG. 1 is shown in a diagrammatic circuit including a fuel pump, an air inlet filter, and an injector rail or throttle body mounted on an engine. The trend in present day automotive design is high performance engines which utilize fuel pumps to deliver fuel to a fuel injection system under pressure.

The pressure regulator to be described is to be located in a circuit including an air inlet, a fuel pump, a fuel injector, and an injector rail or throttle body at the engine.

With reference to the drawings, the regulator to be described has a base housing 10 and a top closure housing 12. The base housing 10 is preferably a die cast housing while the top closure housing can be a stamping suitably assembled to the base housing by an in-turned or spun peripheral edge 14.

The base housing 10 has a central body portion 16 with a side protrusion 18 cored to provide a fuel inlet port 20 into which a nipple 22 is pressed for permanent assembly. The base has a radially extending flange 24.

The top surface of the base 10 is flat to support a flexible diaphragm 30. The central portion of the base, as shown in FIGS. 1 and 2, has a central recess 32 which ensmalls to a calibrated passage 34 which itself enlarges into an outlet port 36 and a fuel tank connector 38. The ensmalled passage 34 is calibrated according to the pressure range desired for the regulator.

A first shallow annular groove 40 (FIGS. 2 and 3) surrounds the central recess 32 to leave a first annular wall 42 surrounding the recess. A second annular groove 44, having a radial dimension greater than groove 40, surrounds and is concentric with wall 42 to leave a second annular wall 46. This groove 44 opens at one side to a passage 48 to connect to pressure fuel inlet port 20 and connector 22.

A short radial passage 50 extends outwardly from groove 44 to perform a function to be described. A second shallow radial passage 52 in annular wall 42 connects the concentric annular grooves 40 with the central recess 32. The function of this passage will be described in conjunction with the operation of the device.

Turning now to the top closure, the housing 12 is formed as a stamping with a tapered flange portion 60 which has a skirt 62 turned in at 14 as previously described. A neck portion 64 rises centrally of the portion 60 to house a coil spring 66 confined at its top end by a retainer cap 68 having a nipple connector 70.

In assembly, the cap 68 is pressed onto the neck portion 64 while in a gauge circuit until the proper spring compression is achieved and then the cap is forcibly dimpled at 72 to lock the cap in place.

The flexible first diaphragm 30 overlying the top surface of the base housing 10 has been mentioned earlier. Above this diaphragm 30 is a spacer ring 74 and above this spacer ring is a second diaphragm 80. These diaphragms 30 and 80 and the spacer ring 74 are clamped securely at the respective outer peripheries by the top closure housing 12 retained by the peripheral edge 14. The diaphragm 30 must be a flexible material which is inert with respect to hydrocarbon fuels. The upper diaphragm is not exposed to fuel and can be formed of any suitable flexible material.

Above the central portion of the base housing and resting on the lower diaphragm 30 is a valve back-up pad 82 which has a central crown 84 extending through centering diaphragm 80. At the base of the crown 84 is a small rim 86 below the inner periphery of the central hole in the diaphragm 80. Above this inner periphery is a ring 88 which provides a mechanical seat in conjunction with the crown 84 for the lower end of coil spring 66. Spaced below the rim 86 of pad 82 is an outwardly extending flange 90 which has a flat bottom to bear on the lower diaphragm 30. Thus, there is a space between the top surface of flange 90 and the upper centering diaphragm 80. It will be noted that the diameter of the flange 90 is greater than the outer diameter of annular recess 44.

IN THE OPERATION

It will be seen in the diagrammatic presentation of FIG. 1 that the regulator valve is interposed in the fuel system of an engine between the fuel pump and the fuel injector which leads to the engine.

The lower diaphragm 30 is thus subject to the fuel pump pressure through connector 22, passage 48 and annular groove 44 and the radial passage 50. At the same time, the inlet air which is reaching the throttle body is also in communication with the top diaphragm 80 through the connector 70 and neck portion 64. The spring 66 is also bearing on the top diaphragm and the lower diaphragm through the central plate 82. If desired, the diaphragm 80 may have a perforation so that the lower diaphragm 30 is exposed to the passage 70.

When pressure elevates in groove 44 to the extent that the effect of the spring 66 is overcome, the plate 82 will lift and fuel will spill over into the outlet and tank passage 36. The short radial passage 50 acts to admit valve lifting pressure on the diaphragm 30 below the periphery of the lower surface of the flange 90 on valve back-up pad 82. The passage 50 extends radially outward beyond the periphery of the flange 90. This increases the area of pressure acting on the diaphragm to lift the valve pad. More than one passage 50 may be used spaced circumferentially, if desired.

The action of the lift-off is enhanced by the centralizing and stabilizing effect of the spring 66 seated centrally on the pad 82 as well as the centralizing effect of the centering diaphragm 80. However, it is rare that the valve will lift straight off the valve area. The valve will generally tilt starting at one side. Here the design of the pad 82 and flange 90 comes into play. It will be noted that the diameter of the pad flange 90 is significantly greater than the valve seat area defined by the annular outer groove 44. For example, in the embodiment shown, the scale is two times the size of the actual device. In this actual devices, the maximum seat diameter is about $\frac{5}{8}$ of an inch, while the diameter of the pad flange 90, when used with a rubber diaphragm, is about $\frac{3}{4}$ of an inch. Thus, when the valve pad starts to lift, even at one side, it will fulcrum on the other side on the flat surface of base 10, and, because of the size of the pad, will open the entire valve seat area.

There is another control function in the structure to contribute to smooth action of the regulator valve. When pressure in annular groove 44 reaches the inner groove 40 as the valve is lifting, this pressure will bleed through the calibrated short radial passage 52 to the recess 32 and the calibrated opening 34. These calibrated restrictions will cause a gradual build-up of pressure so that the valve will not open sharply but will operate smoothly. It will be appreciated that the valve movement may be very slight but will accomplish the necessary by-pass action as required in relation to fuel pump flow at the regulated pressure.

In the function of the valve pad, there is initially pressure in groove 44. As the valve pad and diaphragm 30 rise ever so slightly, pressure bleeds into groove 40 and then through cross-passage 52 to recess 32. This insures the smooth opening of the diaphragm. As the pressure increases in groove 40 and recess 32, there is additional effective pressure area exposed to act on the diaphragm. This will compensate for the increase in spring force as the diaphragm lifts against the spring.

What I claim is:

1. A pressure regulator for use in a fuel system for internal combustion engines utilizing a fuel pump and an air supply which comprises:

(a) a base housing having a fuel inlet to receive fuel under pressure from a fuel pump and having a fuel by-pass outlet, (b) a valve seat formed in a central portion of a flat surface of said base housing between said inlet and said outlet, (c) a first flexible diaphragm overlying said valve seat and said surface of said base housing exposed on one side to fuel pressure in said inlet, (d) a rigid plate having a flat base surface centrally disposed on the other side of said first diaphragm surrounded by radially free space on said diaphragm and overlying said valve seat, said valve seat in said surface occupying a defined central area in said surface, and said plate having a circumference greater than said defined area wherein the edge of said plate will fulcrum on said surface outside said valve seat area to open said valve area, and (e) a spring means bearing on said plate to urge said diaphragm and said plate toward said seat.

2. A pressure regulator as defined in claim 1 in which said valve seat formed in the flat surface of the base housing is comprised of a central passage in said base housing open to said by-pass outlet, a first annular groove in said surface of said base housing outside and spaced from said central passage, and a second annular groove outside and spaced from said first annular groove, said second annular groove being in communication with said fuel inlet, and a radial groove in said surface extending outward from said second annular groove beyond the peripheral extent of said plate to transmit inlet pressure to said flexible diaphragm in an area beyond the radial extent of said plate.

3. A pressure regulator as defined in claim 2 in which said by-pass outlet is restricted in its flow capacity and a restricted radial groove in the valve seat in the flat surface of said base plate connects said first annular groove and said central by-pass outlet.

* * * * *